US006407045B1

(12) United States Patent
Nitsch et al.

(10) Patent No.: US 6,407,045 B1
(45) Date of Patent: Jun. 18, 2002

(54) PARTICULATE ACETONITRILE DERIVATIVES AS BLEACH ACTIVATORS IN SOLID DETERGENTS

(75) Inventors: Christian Nitsch, Duesseldorf; Horst-Dieter Speckmann, Langenfeld; Juergen Haerer; Andreas Lietzmann, both of Duesseldorf, all of (DE); Susan P. Huestis, San Ramon, CA (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/969,169

(22) Filed: Oct. 2, 2001

Related U.S. Application Data

(63) Continuation of application No. 09/460,909, filed on Dec. 14, 1999, now abandoned.
(60) Provisional application No. 60/126,919, filed on Mar. 29, 1999.

(51) Int. Cl.[7] ..... C11D 3/395; C11D 3/26
(52) U.S. Cl. ..... 510/220; 510/224; 510/226; 510/232; 510/276; 510/286; 510/298; 510/302; 510/310; 510/311; 510/312; 510/314; 510/349; 510/367; 510/372; 510/376; 510/511

(58) Field of Search ..... 510/220, 224, 510/226, 232, 276, 286, 298, 302, 310, 311, 312, 314, 349, 367, 372, 376, 511

(56) References Cited

U.S. PATENT DOCUMENTS 5,783,540 A * 7/1998 Secemski et al. ..... 510/224
5,888,419 A * 3/1999 Casella et al. ..... 252/186.39
5,900,395 A * 5/1999 Nicholson et al. ..... 510/224

* cited by examiner

*Primary Examiner*—Charles Boyer
(74) *Attorney, Agent, or Firm*—Glenn E. J. Murphy

(57) ABSTRACT

The invention set out to improve the oxidizing and bleaching effect of inorganic peroxygen compounds in dishwashing, more particularly machine dishwashing, in terms of their storage stability. This was essentially achieved by using particulate compounds corresponding to formula $R^1R^2R^3N^-CH_2CN\ X^+$, in which $R^1$, $R^2$, and $R^3$ independently of one another represent an alkyl, alkenyl or aryl group containing 1 to 18 carbon atoms, in addition to which the groups $R^2$ and $R^3$ may even be part of a heterocycle including the N atom and optionally other hetero atoms, and X is a charge-equalizing anion. Dishwashing detergents, more particularly machine dishwashing detergents, contain about 1% by weight to 10% by weight of this bleach-boosting agent.

28 Claims, No Drawings

PARTICULATE ACETONITRILE DERIVATIVES AS BLEACH ACTIVATORS IN SOLID DETERGENTS

This application claims benefit of DE 198 57 596.3 filed Dec. 15, 1998 and U.S. Provisional Application No. 60/126,919 filed Mar. 29, 1999, under 35 U.S.C. §119 and benefit of continuation U.S. Ser. No. 09/460,909, filed Dec. 14, 1999, under 35 U.S.C. §120, now abandoned.

BACKGROUND OF THE INVENTION

This invention relates to the use of particulate acetonitrile derivatives as activators for peroxygen compounds, more particularly inorganic peroxygen compounds, for bleaching colored soil on soils and to dishwashing detergents containing such activators.

Inorganic peroxygen compounds, more particularly hydrogen peroxide, and solid peroxygen compounds which dissolve in water with release of hydrogen peroxide, such as sodium perborate and sodium carbonate perhydrate, have long been used as oxidizing agents for disinfecting and bleaching purposes. The oxidizing effect of these substances in dilute solutions depends to a large extent on the temperature.

For example, with $H_2O_2$ or perborate in alkaline bleaching liquors, soiled textiles are only bleached sufficiently quickly at temperatures above about 80° C. At lower temperatures, the oxidizing effect of the inorganic peroxygen compounds can be improved by the addition of so-called bleach activators, for which numerous proposals, above all from the classes of N- or O-acyl compounds, for example polyacylated alkylene-diamines, more especially tetraacetyl ethylenediamine, acylated glycolurils, more especially tetraacetyl glycoluril, N-acylated hydantoins, hydrazides, triazoles, hydrotriazines, urazoles, diketopiperazines, sulfuryl amides and cyanurates, also carboxylic anhydrides, more especially phthalic anhydride, carboxylic acid esters, more especially sodium nonanoyloxy benzene-sulfonate, sodium isononanoyloxy benzenesulfonate, and acylated sugar derivatives, such as pentaacetyl glucose, have become known in the literature. By adding these substances, the bleaching effect of aqueous peroxide liquors can be increased to such an extent that substantially the same effects are obtained at temperatures of only around 60° C. as are obtained with the peroxide liquor alone at 95° C.

In the search to find energy-saving washing and bleaching processes, application temperatures well below 60° C., more particulary below 45° C. down to the temperature of cold water, have acquired increasing significance in recent years. At these low temperatures, there is generally a discernible reduction in the effect of the hithereto known activator compounds. Accordingly, there has been no shortage of attempts to develop more effective activators for this temperature range, but so far to no real avail.

Another problem which particularly affects machine dishwashing detergents is the need to incorporate corrosion inhibitors for table silver in such detergents, particularly where the detergents contain the oxygen-based bleaching or oxidizing agents which have recently become more widespread. During the dishwashing process, silver is capable of reacting with sulfur-containing substances dissolved or dispersed in the wash liquor, because food residues, including inter alia mustard, peas, egg and other sulfur-containing compounds, such as mercaptoamino acids, are introduced into the wash liquor in the cleaning of dishes in domestic dishwashing machines. The far higher temperatures prevailing during machine dishwashing and the longer contact times with the sulfur-containing food remains also promote the tarnishing of silver by comparison with manual dishwashing. In addition, the silver surface is completely degreased by the intensive cleaning process in the dishwashing machine and, as a result, becomes more sensitive to chemical influences.

The problem of tarnishing becomes acute in particular when active oxygen compounds, for example sodium perborate or sodium percarbonate, are used alternatively to the active chlorine compounds which oxidatively "deactivate" the sulfur-containing substances in order to eliminate bleachable soils, such as example tea stains/tea films, coffee residues, dyes from vegetables, lipstick residues and the like. Active oxygen bleaching agents of the type in question are used in machine dishwashing detergents, generally together with bleach activators. These detergents generally consist of the following functional components: builder component (complexing agent/dispersant), alkali carrier, bleaching system (combination of bleaching agent and bleach activator), enzyme and surfactant. Under the dishwashing conditions prevailing where detergents such as these are used, not only sulfidic coatings, but also oxidic coatings are generally formed on the silver surfaces—where silver is present—through the oxidizing effect of the peroxides formed as intermediates or the active oxygen.

It is known from international patent application WO 98/23719 that compounds corresponding to general formula I:

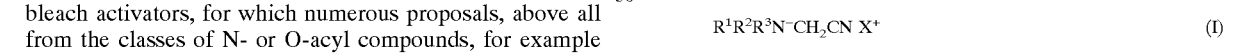

$$R^1R^2R^3N^{-}CH_2CN\ X^{+} \quad (I)$$

in which $R^1$, $R^2$, and $R^3$ independently of one another represent an alkyl, alkenyl or aryl group containing 1 to 18 carbon atoms, in addition to which the groups $R^2$ and $R^3$ may even be part of a heterocycle including the N atom and optionally other hetero atoms, and X is a charge-equalizing anion, can be used as activators for peroxygen compounds, more especially inorganic peroxygen compounds, in aqueous dishwashing solutions. An improvement in the oxidizing and bleaching effect of peroxygen compounds, more especially inorganic peroxygen compounds, at low temperatures below 80° C. and, more particularly, in the range from about 15° C. to 55° C. is achieved in this way. The compounds corresponds to general formula (I) are normally unstable in storage and, in particular, extremely sensitive to moisture, especially in combination with other ingredients of detergents. Some of the representatives of the compounds of general formula (I) which have a particularly good bleach-boosting effect are liquid at room temperature while others are obtained in liquid form, for example as aqueous solutions, at the end of their production process and can only be converted from liquid from into the pure solid with considerable losses. In both cases, their use in solid detergents, for example particulate detergents, is problematical.

A sub-class of particulate detergents are detergents in tablet form. Tabletted detergents have a number of advantages over powder-form or liquid products. They are easier to dose and handle and, by virtue of their compact structure, have advantages in regard to storage and transportation. Accordingly, there is an extremely broad prior art on detergent tablets which is also reflected in extensive patient literature. At a very early stage, developers of tablet-form products had the idea of releasing certain ingredients into the wash cycle under defined conditions through differently composed parts of the tablets in order in this way to improve the outcome of the cleaning process. Besides the core/jacket tablets and ring/core tablets known for some time in the pharmaceutical industry, multilayer tablets in particular have been successfully used and are now available for many aspects of washing and cleaning or hygiene.

Multiphase lavatory cleaning tablets are described, for example, in European patent application EP 0 055100. This document discloses toilet cleaning blocks which comprise a block of a slowly dissolving cleaning composition in which a bleaching tablet is embedded. The document in question also disclosed various embodiments of multiphase tablets. According to the teaching of EP 0 055 100, the tablets are produced either by introducing a bleaching tablet into a mold and coating the tablet with the cleaning composition or by casting part of the cleaning composition into the mold, introducing the bleaching tablet and, optionally, overcoating with more cleaning composition.

European patent application EP 0 481 547 also describes multiphase detergent tablets which, according to this document, are intended for use in dishwashing machines. These tablets are core/jackets and are produced by pressing the ingredients in stages, First, a bleaching composition is converted into a pressing which is introduced into a die half-filled with a polymer composition which is then filled with more polymer composition and converted into a bleaching tablet with a polymer jacket. The procedure is then repeated with an alkaline detergent composition so that a three-phase tablet is obtained.

International patent application WO 98/23531 describes N-alkyl ammonium nitriles of the type corresponding to formula (I) above which are made up in granular form, silica silicates and aluminum oxide, for example, being mentioned as carrier materials for the N-alkyl ammonium nitriles.

It has been found that particulate acetonitrile derivatives of the type mentioned above can be incorporated in storage-stable form in solid, more especially tablet-form, detergents without any of the disadvantages mentioned above, another advantage being that bleaching performance is increased by comparison with compositions which contain the acetonitrile derivative merely as an added or individual component.

DESCRIPTION OF THE INVENTION

The present invention relates to the use of compounds corresponding to general formula (I) below made up in particulate form with inorganic silicon-containing carrier materials:

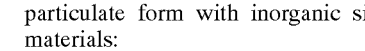

$$R^1R^2R^3N^-CH_2CN\ X^+ \quad (I)$$

in which $R^1$, $R^2$, and $R^3$ independently of one another represent an alkyl, alkenyl or aryl group containing 1 to 18 carbon atoms, in addition to which the groups $R^2$ and $R^3$ may even be part of a heterocycle including the N atom and optionally other hetero atoms, and X is a charge-equalizing anion, can be used as activators for peroxygen compounds, more especially inorganic peroxygen compounds, in solid detergents, more especially dishwashing detergents, which are used in substantially aqueous cleaning solutions.

Compounds corresponding to formula I may be prepared by known methods, as published for example by Abraham in Prog. Phys. Org. Chem. 11 (1974), pages 1 et seq. or by Arnett in J.Am. Chem. Soc. 102 (1980), pages 5892 et seq., or by similar methods. Some compounds corresponding to general formula I are described in hithereto unpublished International patent application WO 96/40661. It is particularly preferred to use compounds corresponding to formula I in which R2 and R3 form a morpholinium ring together with the quaternary nitrogen atom. In these compounds, R1 is preferably an alkyl group containing 1 to 3 carbon atoms, more especially a methyl group.

The anions X include, in particular, the halides, such as chloride, fluoride, iodide and bromide, nitrate, hydroxide, hexafluorophosphate, sulfate, hydrogen sulfate, metho- and ethosulfate, chlorate, perchlorate and the anion of carboxylic acids, such as formate, hydrogen sulfate or methosulfate are preferably used.

The compound corresponding to general formula I is used in the detergents in particulate form, i.e. applied to an inorganic carrier material. Application to the carrier material may be carried out by stirring the carrier material into an aqueous solution of the compound corresponding to formula I, such as accumulates in the course of its production, and removing the aqueous solvent in vacuo, optionally at elevated temperature. However, the solution of the compound of formula I may also be sprayed onto the carrier material and subjected to a drying process either at the same or optionally at a later stage. The particles formed preferably have a diameter of 0.4 mm to 1.2 mm.

Preferred silicon-containing inorganic carrier materials are these which have an inner surface 10 $m^2/g$ to 500 $m^2/g$ and, more particularly, in the range from 100 $m^2/g$ to 450 $m^2/g$. Suitable carrier materials are, for example, silicates, silicas, silica gels and clays and also mixtures thereof. However, the carrier material is preferably free from zeolites.

Silicas which have been produced by a thermal process (flame hydrolysis of SiCl4), so-called pyrogenic silicas, are as suitable as silicas produced by wet processes. Silica gels are colloidal silicas with an elastic or firm consistency and a substantially loose pore structure which provides them with a high capacity of absorbing liquids. They can be produced by the action of mineral acids on water glass. Clays are naturally occurring crystalline or amorphous silicates of aluminum, iron, magnesium, calcium, potassium and sodium, for example kaolin, talcum, pyrophillite, attapulgite, sepiolite, montmorillonite and bauxite. Aluminum silicate may also be used as the carrier material or as a component of a mixture of carrier materials. The carrier material preferably has particles sizes in the range from 100 $\mu$m to 1.5 mm. of the compound corresponding to formula I.

The acetonitrile derivative made up in particular form with the silicon-containing carrier material may additionally contain and/or be coated with an inorganic material having a melting point above 40° C., more especially a nonionic surfactant. This can have a positive effect on the disintegrating properties of the corresponding particle in aqueous systems and/or on its stability in storage.

The particulate acetonitrile derivative corresponding to formula I is preferably incorporated in detergents which are intended for use in dishwashing solutions for bleaching colored stains. In the context of the present invention, the term bleaching is understood to encompass both the bleaching of soil present on the surface of the dishes, more especially tea, and the bleaching of soil present in the dishwashing liquor after detachment from the surface.

The present invention also relates to solid dishwashing detergents, preferably machine dishwashing detergents, containing a compound corresponding to formula I of the type described above in particulate from and to a dishwashing process using such a particulate compound.

The use according to the invention as a bleach activator essentially comprises creating conditions—in the present of a surface soiled with colored soils—under which a peroxidic oxidizing agent and the bleach-activating acetonitrile derivative are capable of reacting with one another with a view to obtaining reaction products having a stronger oxidizing effect. Conditions of the type in question prevail in particular when the two reactants meet one another in aqueous solution. This can be achieved by separately adding the peroxygen compound and the acetonitrile derivative to an optionally detergent-containing solution. However, the process according to the invention is carried out with particular advantage using a dishwashing detergent according to the invention which contains the bleach-activating acetonitrile derivative and optionally a peroxygen-containing oxidizing agent preferably selected from the group consisting of organic peracids, hydrogen peroxide, perborate and percarbonate and mixtures thereof. The peroxygen compound may even be separately added to the solution either as much or preferably in the form of an aqueous solution or suspension in cases where a peroxide-free detergent is used.

The conditions may be varied within wide limits, depending on the application envisaged. Thus, besides pure aqueous solutions, mixtures of water and suitable organic solvents may also be used as the reaction medium. The quantities of peroxygen compounds used are generally selected so that the solutions contain between 10 ppm and 10% of active oxygen and preferably between 50 ppm and 5,000 ppm of active oxygen. The quantity of bleach-activating acetonitrile derivative used also depends on the application envisaged. Depending on the required degree of activation, between 0.00001 mole and 0.25 mole and preferably between 0.001 and 0.02 mole of activator is used per mole of peroxygen compound, although larger or smaller quantities may also be used in special cases.

The present invention also relates to a solid dishwashing detergent containing 1% by weight to 10% by weight and, more particularly, 2% by weight to 6% by weight of an acetonitrile derivative corresponding to formula I in particulate form in addition to typical ingredients compatible with the compound.

In addition to the bleach activator used in accordance with the invention, the detergents according to the invention, may be present as powder-form or tablet-form solids, homogeneous solutions or suspensions, may in principle contain any of the known ingredients typically encountered in such detergents. More particularly, the detergents according to the invention may contain builders, surfactants, peroxygen compounds, water-miscible organic solvents, enzymes, sequestering agents, electrolytes, pH regulators and other auxiliaries, such as silver corrosion inhibitors, foam regulators, additional bleach boosters and dyes and fragrances.

In addition, a detergent according to the invention may contain abrasive ingredients, more especially from the group consisting of silica flours, wood flours, polymer powders, chalks and glass microbeads and mixtures thereof. Abrasives are present in the detergent according to the invention in quantities of preferably not more than 20% by weight and, more particularly, in quantities of 5% by weight to 15% by weight.

The present invention also relates to a machine dishwashing detergent containing 15% by weight to 70% by weight and, more especially, 20% by weight to 60% by weight of a water-soluble builder component, 5% by weight to 25% by weight and, more especially, 8% by weight to 17% by weight of an oxygen-based bleaching agent, based on the detergent as a whole, characterized in that it contains a bleach-activating acetonitrile derivative corresponding to formula I in the particulate form described above, more especially in quantities of 2% by weight to 6% by weight. A detergent of the type in question is preferably a low-alkali detergent, i.e. a 1% by weight solution of the detergent has a pH value of 8 to 11.5 and, more particularly, in the range from 9 to 11.

In principle, the water-soluble builder component, more especially in low-alkali machine dishwashing detergents of the type in question, may be selected from any of the builders typically used in machine dishwashing detergents, for example alkali metal phosphates which may be present in the form of their alkaline, neutral or acidic sodium or potassium salts. Examples of such alkali metal phosphates are trisodium phosphate, tetrasodium diphosphate, disodium dihydrogen diphosphate, pentasodium triphosphate, so-called sodium hexametaphosphate, oligomeric trisodium phosphate with degrees of oligomerization of 5 to 1,000 and, more particularly, 5 to 50, and mixtures of sodium and potassium salts. They may be present in quantities of up to about 55%by weight, based on the detergent as a whole. Other possible water-soluble builder components are, for example, organic polymers of native or synthetic origin, above all polycarboxylates which act as co-builders, particularly in hard water areas. Example of builders such as these are, for example, polyacrylic acids and copolymers of maleic anhydride and acrylic acid and the sodium salts of these polymer acids. Commercially available products are, for example, Sokalan® CP 5, CP 10 and PA 30 (BASF). The polymers of native origin suitable as co-builders include, for example, the oxidized starches known, for example, from International patent application WO 94/05762 and polyamino acids, such as polyglutamic acid or polyaspartic acid. Other possible builder components are naturally occurring hydroxycarboxylic acids such as, for example, mono- and dihydroxysuccinic acid,—hydroxypropionic acid and gluconic acid. Preferred builder components are the salts of citric acid, more especially sodium citrate. The sodium citrate used may be anhydrous sodium citrate and is preferably trisodium citrate dihydrate. Trisodium citrate dihydrate may be used as a fine or coarse crystalline powder. The acids corresponding to the co-builder salts mentioned may also be at least partly present, depending on the pH value ultimately established in the detergents according to the invention.

Suitable oxygen-based bleaching agents are, above all, alkali metal perborate monohydrate and tetrahydrate and/or alkali metal percarbonate and alkali metal persulfates, persilicates and percitrates, sodium being the preferred alkali metal, the use of sodium percarbonate has advantages, especially in dishwashing detergents, because it has a particularly favorable effect on the corrosion behavior of glasses. Accordingly, the oxygen-based bleaching agent is preferably an alkali metal percarbonate, more especially sodium percarbonate. Known peroxycarboxylic acids, for example dodecane diperacid, or phthalimidopercarboxylic acids which may optionally be substituted at the aromatic radical may be present in addition to or, more particularly, as an alternative to the oxygen-based bleaching agent. Moreover, the addition of small quantities of known bleach stabilizers, for example phosphonates, borates and metaborates and metasilicates and also magnesium salts, such as magnesium sulfate, can be useful.

In addition to the bleach-activating acetonitrile derivatives corresponding to formula I crucial to the invention, known coventional bleach activators, i.e. compounds which form aliphatic peroxocarboxylic acids preferably containing 1 to 10 carbon atoms and, more particularly, 2 to 4 carbon atoms and/or optionally substituted perbenzoic acid under perhydrolysis conditions, may be used. Suitable conventional bleach activators are substances which carry O- and/or N-acyl groups with the number of carbon atoms mentioned and/or optionally substituted benzoyl groups. Preferred conventional bleach activators are polyacylated alkylenediamines, more especially tetraacetyl ethylenediamine (TAED), acylated triazine derivatives, more especially 1,5-diacetyl-2,4-dioxohexahydro-1,3,5-triazine (DADHT), acylated glycolurils, more especially tetraacetyl glycoluril (TAGU), N-acyl imides, more especially N-nonanoyl succinimide (NOSI), carboxylic anhydrides, more especially phthalic anhydride, acylated polyhydric alcohols, more especially triacetin, ethylene glycol diacetate, 2,5-diacetoxy-2,5-dihydrofuran and the enol esters known from German patent applications DE 196 693 and DE 196 16 767 and also acetylated sorbitol and mannitol and the mixtures thereof (SORMAN) described in European patent application EP 0 525 239, acylated sugar derivatives, more especially pentaacetyl glucose (PAG), pentaacetyl fructose, tetraacetyl xylose and octaacetyl lactose and acetylated, optionally N-alkylated, glucamine and glucolactone, and/or N-acylated lactams, for example N-benzoyl caprolactam, which are known from International patent applications WO 94/27970, WO 94/28102, WO 94/28103, WO 95/00626, WO 95/14759 and WO 95/17498. The hydrophilically substituted acyl acetals known from German patent application DE 196 16 769 and the acyl lactams described in German patent application DE 196 16 770 and in International patent application WO 95/14075 are also preferably used. The combinations of conventional bleach activators known from German patent application DE 44 43 177 may also be used. Conventional bleach activators such as these are present in the usual quantities, prefarably in quantities of 0.1% by weight to 10% by weight and more preferably in quantities of 0.5% by weight to 7% by weight, based on the detergent as a whole.

In addition to or instead of the conventional bleach activators mentioned above, the sulfonimines known from European patents EP 0 446 982 and EP 0 453 003 and/or bleach-boosting transition metal salts or transition metal complexes may be present as so-called bleach catalysts. Suitable transition metal compounds include in particular the manganese-, iron-, cobalt-, ruthenium- or molybdenum-salen complexes known from German patent application DE 195 29 905 and the N-analog compounds thereof known from German patent application DE 196 20 267, the manganese-, iron-, cobalt-, ruthenium- or molybdenum-carbonyl complexes known from German patent application DE 195 36 082, the manganese, iron, cobalt, ruthenium, molybdenum, titanium, vanadium and copper complexes with nitrogen tripod ligands described in German patent application DE 196 05 688, the cobalt-, iron-, copper-, and ruthenium-ammine complexes known from German patent application DE 196 20 411, the manganese, copper and cobalt complexes described in German patent application DE 44 16 438, the cobalt complexes described in European patent application EP 0 272 030, the manganese complexes known from European patent application EP 0 693 550, the manganese, iron, cobalt and copper complexes known from European patent EP 0 392 592 and/or the manganese complexes described in European patent EP 0 443 651 in or European patent applications EP 0 458 397, EP 0 458 398, EP 0 549 271, EP 0 549 272, EP 0 544 490 and EP 0 544 519. Combinations of bleach activators and transition metal bleach catalysts are known, for example, from German patent application DE 196 13 103 and International patent application WO 95/27775. Bleach-boosting transition metal salts and/or complexes, more particularly containing the central atoms Mn, Fe, Co, Cu, Mo, V, Ti and/or Ru, are used in typical quantities, preferably in quantities of up to 1% by weight, more preferably in quantities of 0.0025% by weight to 0.5% by weight and most preferably in quantities of 0.1% by weight to 0.1% by weight, based on the detergent as a whole. Particularly preferred bleach catalyst complexes include cobalt-, iron-, copper-, and ruthenium-ammine complexes, for example [Co(NH3)5Cl]Cl2 and/or [Co(NH3)5Cl]Cl2. In another preferred embodiment, the compositions contain a bleach-boosting active-substance combination obtainable in accordance with European patent application EP 0 832 969 by intimately mixing a water-soluble salt of a divalent transition metal selected from cobalt, iron, copper and ruthenium and mixtures thereof, water-soluble ammonium salt and optionally a peroxygen-based oxidizing agent and inert carrier material in quantities of preferably 0.25% by weight to 25% by weight and, more preferably, 1% by weight to 10% by weight in addition to the particulate bleach activator corresponding to formula I. The particulate bleach activator corresponding to formula I is preferably used in the presence of this combination of active substances.

The machine dishwashing detergents according to the invention preferably contain the usual alkali carriers, for example alkali metal silicates, alkali metal carbonates and/or alkali metal hydrogen carbonates. The alkali carriers normally used include carbonates, hydrogen carbonates and alkali metal silicates with a molar SiO2:M2O ratio (M=alkali metal atom) of 1:1 to 2.5:1. Alkali metal silicates may be present in quantities of up to 40% by weight, based on the detergent as a whole. However, the highly alkaline metasilicates are preferably not used at all as alkali carriers. The alkali carrier system preferably used in the detergent according to the invention is a mixture of carbonate and hydrogen carbonate, preferably sodium carbonate and hydrogen carbonate, which is present in a quantity of up to 50% by weight and preferably in quantity of 5% by weight to 40% by weight. The ratio of carbonate used to hydrogen carbonate used varies according to the pH value ultimately required.

In another embodiment, the detergents according to the invention contain 20% by weight to 60% by weight of water-soluble organic builder, more especially alkali metal citrate, 3% by weight to 20% by weight of alkali metal carbonate and 5% by weight to 40% by weight of alkali metal disilicate.

Anionic, nonionic and/or amphoteric surfactants, more especially low-foaming nonionic surfactants, may also be added to the detergents according to the invention to improve the removal of fatty-containing soils, as wetting agents and optionally as granulation aids in the production of the detergents. They may be added in quantities of up to 20% by weight, preferably in quantities of up to 10% by weight and more preferably in quantities of 0.5% by weight to 5% by weight. Extremely low-foaming compounds are normally used, especially in machine dishwashing detergents. Such compounds are preferably C12–18 alkyl polyethylene glycol polypropylene glycol ethers containing up to 8 moles of ethylene oxide units and up to 8 moles of propylene oxide units in the molecule. However, other known low-foaming nonionic surfactants may also be used, including for example C12–18 alkyl polyethylene glycol polybutylene glycol ethers containing up to 8 moles of ethylene oxide units and up to 8 moles of butylene oxide units in the molecule, end-capped alkyl polyalkylene glycol mixed ethers and the foaming, but ecologically attractive C8–14 alkyl polyglucosides with a degree of polymerization of about 1 to 4 (for example APG® 225 and APG® 600 of Henkel KGaA) and/or C12–14 alkyl polyethylene glycols containing 3 to 8 ethylene oxide units in the molecule. Surfactants from the glucamide family, for example alkyl-N-methyl glucamides in which the alkyl moiety preferably emanates from a C6–14 fatty alcohol, are also suitable. The described surfactants may also be advantageously used in the form of mixtures, for example in the form of a mixture of alkyl polyglycoside with fatty alcohol ethyoxylates or a mixture of glucamide with alkyl polyglycosides.

If desired, the dishwashing detergents according to the invention may contain silver corrosion inhibitors. Preferred silver corrosion inhibitors are organic sulfides, such as cystine and cysteine, dihydric or trihydric phenols, optionally alkyl-, aminoalkyl- or aryl- substituted triazoles, such as benzotriazole, isocyanuric acid, manganese, cobalt, titanium, zirconium, hafnium, vanadium or cerium salts and/or complexes in which the metals mentioned have the oxidation number II, III, IV, V or VI, depending on the metal. The content of silver corrosion inhibitors in the detergents according to the invention is preferably in the range from 0.01% by weight to 1.5% weight and more preferably in the range from 0.1% by weight to 0.5% by weight. Thus, the manganese(III) or manganese(IV) complexes known from international patent application WO 94/19445, the cysteine disclosed as a silver protector in the International patent application WO 94/07981, the cystine described in German patent application DE 193 18 693 as having a silver-corrosion-inhibiting effect either on its own or, in particular, in combination with isocyanuric acid and/or the titanium, zirconium, hafnium, vanadium, cobalt or cerium salts and/or complexes described in German patent applications DE 43 25 922 or DE 43 15 397, in which the metals have the oxidation number II, III, IV, V or VI, and the manganese(II) salts or complexes mentioned in those patent applications may be used in the detergents according to the invention to prevent the corrosion of silver.

The detergents according to the invention may additionally contain enzymes, such as proteases, amylases, pullulanases, cutinases and lipases, for example proteases, such as BLAP®, Optimase®, Opticlean®, Maxacal®, Maxapem®, Esperase®, Savinase®, Purafect® OxP and/or Durazym®, amylases, such as Termamyl®, Amylase-LT®, Maxamyl®, Duramyl® and/or Purafect® OxAm, lipasas, such as Lipolase®, Lipomax®, and/or Lipozym®. The exzymes optionally used may be adsorbed onto supports and/or encapsulated in shell-forming substances to protect them against premature inactivation, as described for example in International patent applications WO 92/11347 or WO 94/23005. They are present in the detergents according to the invention in quantities of preferably up to 2% by weight and more preferably in quantities of 0.1% by weight to 1.5% by weight, enzymes stabilized against oxidative degradation, as known for example from International patent applications WO 94/02597, WO 94/02618, WO 94/18314, WO 94/23053 or WO 95/07350, being particularly preferred.

If the detergents foam too vigorously in use, preferably up to 6% by weight and more preferably about 0.5% by weight to 4% by weight of a foam-suppressing compound, preferably from the group of silicone oils, mixtures of silicone oil and hydrophobicized silica, paraffins, paraffin/ alcohol combinations, hydrophobicized silica, bis-fatty acid amides and other known commercially available defoamers, may be added to them. Other optional ingredients in the detergents according to the invention are, for example, perfume oils.

In order to establish a desired pH value which is not automatically established by the mixture of the other components, the detergents according to the invention may contain system-compatible and environ-mentally compatible acids, more particularly citric acid, acetic acid, tartaric acid, malic acid, lactic acid, glycolic acid, succinic acid, glutaric acid and/or adipic acid and also mineral acids, more especially sulfuric acid, or alkali metal hydrogen sulfates or bases, more especially ammonium or alkali metal hydroxides. pH regulators such as these may be present in the detergents according to the invention in quantities of preferably not more than 10% by weight and, more preferably, in quantities of 0.5% by weight to 6% by weight.

In order to facilitate the disintegration of detergents according to the invention, particularly where they are present in the form of highly compacted tablets, disintegrating agents, so-called tablets disintegrators, may be incorporated to shorten the disintegration times. According to R ömpp (9th Edition, Vol. 6, page 4440) and Voight "Lehrbuch der Pharmazeutischen Technologie" (6th Edition, 1987, pages 182–184), tablet disintegrators or disintegration accelerators are understood to be auxiliaries which provide for the rapid disintegration of tablets in water or gastric juice and for the release of the pharmaceutical products in resorbable form. These substances, which are also known as "disintegrators" by virtue of their action, undergo an increase in volume on contact with water. On the one hand, they undergo an increase in their own volume (swelling), on the other hand a pressure can be built up through the release of gases which enables the tablet to break up into relatively small particles. Well-known disintegration aids are, for example, carbonate/citric acid systems where the citric acid may also be replaced by other organic acids. Swelling disintegration acids are, for example, synthetic polymers, such as polyvinyl pyrrolidone (PVP), or natural polymers or modified naturally occurring materials, such as cellulose and starch and derivatives thereof, alginates or casein derivatives. In preferred variants of the process, the compounds or premixes to be tabletted contain from 0.5 to 10% by weight, preferably from 1 to 5% by weight and more preferably from 2 to 4% by weight of a disintegration aid, based on the compound. According to the invention, preferred disintegrating agents are cellulose-based disintegrating agents, so that preferred detergent tablets contain such a cellulose-based disintegrating agent in quantities of 0.5 to 10% by weight, preferably 1 to 5% by weight and more preferably 2 to 4% by weight. Pure cellulose has the formal empirical composition $(C_6H_{10}O_5)_n$ and, formally, is a—1,4-polyacetal of cellobiose which, in turn, is made up of two molecules of glucose. Suitable celluloses consist of ca. 500 to 5,000 glucose units and, accordingly, have average molecular weights of 50,000 to 500,000. According to the invention, cellulose derivatives obtainable from cellulose by polymer-analog reactions may also be used as cellulose-based disintegrating agents. These chemically modified cellulose include, for example, products of esterification or etherification reactions in which hydroxy hydrogen atoms have been substituted. Celluloses in which the hydroxy groups have been replaced by functional groups that are not attached by an oxygen atom may also be used as cellulose derivatives. The group of cellulose derivatives includes, for example, alkali celluloses, carboxymethyl cellulose (CMC), cellulose esters and ethers and amino-celluloses. The cellulose derivative mentioned are preferably not used as disintegrating agents on their own, but rather in the form of a mixture with cellulose. The content of cellulose derivatives in mixtures such as these is preferably below 50% by weight and more preferably below 20% by weight, based on the cellulose-based disintegrating agent. In a particularly preferred embodiment, pure cellulose free from cellulose derivatives is used as the cellulose-based disintegrating agent. Microcrystalline cellulose may be used as another cellulose-based disintegrating agent or as part of such a component. The microcrystalline cellulose is obtained by partial hydrolysis of celluloses under conditions which only attack and completely dissolve the amorphous regions (ca. 30% of the total cellulose mass) of the celluloses, but leave the crystalline regions (ca. 70%) undamaged. Subsequent deaggregation of the microcelluloses formed by the hydrolysis provides the microcrystalline celluloses which have primary particle sizes of about 5 μm and which may be compacted, for example, to form granules with an average particle size of 200 μm.

The detergents according to the invention are preferably present as powder-form, granular or tablet-form preparations which can be produced in known manner, for example by mixing, granulation, roll compacting and/or by spray drying of the heat-sensitive components and adding the more sensitive components, including in particular enzymes, bleaching agents and the bleach activator.

Detergents according to the invention in the form of dust-free, storage-stable and free-flowing powders and/or granules with high bulk densities of 800 to 1000 g/l can be produced by mixing the builder components with at least pert of the liquid components in a first stage in which the bulk density of the resulting compound is also increased and then combining the other components of the detergent, including the particulate bleach catalyst corresponding to formula I, with the compound thus obtained, if desired after drying.

In one preferred embodiment, the detergents according to the invention are present in the form of pressed elements, more especially tablets, which are produced by pressing a compound containing all the ingredients suitable for compositions according to the invention. The compound may be composed of various substances, as described above. Irrespective of the composition of the compounds to be pressed, physical parameters of the compounds may be selected so that advantageous properties are established in the pressed elements. Thus, in preferred variants, the particulate compounds to be pressed have bulk densities above 600 g/l, preferably above 700 g/l and more preferably above 800 g/l.

The particulate size of the compounds to be pressed can also be adjusted to establish favorable properties in the pressed elements. In preferred processes, the pressed particulate compound has a particle size distribution in which less than 10% by weight, preferably less than 7.5% by weight and, more preferably, less than 5% by weight of the particles are larger than 1600 μm or smaller than 200 μm in size. Narrower particle size distributions are more preferred. Particularly advantageous variants are characterized in that the particulate compound to be pressed has a particle size distribution in which more than 30% by weight, preferably more than 40% by weight and more preferably more than 50% by weight of the particles have a particle size of 600 to 1000 μm.

To produce tablets, the compound is compacted between two punches in a dies to form a solid compactate. This process, which is referred to in short hereinafter as tabletting, comprises four phases, namely metering, compacting (elastic deformation), plastic deformation and ejection.

The compound is first introduced into the die, the filling level and hence the weight and shape of the tablet formed being determined by the position of the lower punch and the shape of the die. Uniform metering, even at high tablet throughputs, is preferably achieved by volumetric meeting of the compound. As the tabletting process continues, the top punch comes into contact with the compound and continues descending towards the bottom punch. During this compaction phase, the particles of the compound are pressed closer together, the void volume in the filling between the punches continuously diminishing. The plastic deformation phase in which the particles coalesce and form the tablet beings from a certain position of the top punch (and hence from a certain pressure on the compound). Depending on the physical properties of the compound, its constituent particles are also partly crushed, the compound sintering at even higher pressures. As the tabletting rate increases, i.e. at high throughputs, the elastic deformation phase becomes increasingly shorter so that the tablets formed can have more or less large voids. In the final step of the tabletting process, the tablet is forced from the die by the bottom punch and carried away by following conveyors. At this stage, only the weight of the tablet is definitively established because the tablets can still change shape and size as a result of physical processes (re-elongation, crystallographic effects, cooling, etc.).

The tabletting process is carried out in commercially available tablet process which, in principle, may be equipped with single or double punches. In the latter case, not only is the top punch used to build up pressure, the bottom punch also moves towards the top punch during the tabletting process while the top punch presses downwards. For small production volumes, it is preferred to use eccentric tablet presses in which the punch(es) is/are fixed to eccentric disc which, in turn, is mounted on a shaft rotating at a certain speed. The movement of these punches is comparable with the operation of a coventional four-stroke engine. Tabletting can be carried out with a top punch and a bottom punch, although several punches can also be fixed to a single eccentric disc, in which case the number of the die bores correspondingly increased. The throughputs of eccentric presses vary according to the type from a few hundred to at most 3,000 tablets per hour.

For larger throughputs, rotary tablet presses are generally used. In rotary tablet presses, a relatively large number of dies is arranged in a circle on a so-called die table. The number of dies varies—according to model—between 6 and 55, although even larger dies are commercially available. Top and bottom punches are associated with each die on the die table, the tabletting pressures again being actively built up not only by the top punch or bottom punch, but also by both punches, The die table and the punches move about a common vertical axis, the punches being brought into the filling, compaction, plastic deformation and ejection positions by means of curved guide rails. At those places where the punches have to be raised or lowered to a particularly significant extents (filling, compaction, ejection), theses curved guide rails are supported by additional push-down members, pull-down rails and ejection paths. The die is filled from a rigidly arranged feed unit, the so-called filling shoe, which is connected to a storage container for the compound. The pressure applied to the compound can be individually adjusted through the tools for the top and bottom punches, pressure being built up by the rolling of the punch shank heads past adjustable pressure rollers. To increase throughput, rotary presses can also be equipped with two filling shoes so that only half a circle has to be negotiated to produce a tablet. To produce two-layer or multiple-layer tablets, several filling shoes are arranged one behind the other without the lightly compacted first layer being ejected before further filling. Given suitable process control, shell and point tables—which have structure resembling an anion skin—can also be produced in this way. In the case of point tablets, the upper surface of the core or the core layers is not covered and thus remains visible. Rotary tablet presses can also be equipped with single or multiple punches so that, for example, an outer circle with 50 bores and an inner circle with 35 bores can be simultaneously used for tabletting. Modern rotary tablet presses have throughputs of more than one million tablet per hour.

Suitable tabletting machines can be obtained, for example, from the following companies: Apparatebau Holzwarth Gbr, Asperg, Wilhelm Fette GmbH, Schwarzenbek, Hofer GmbH, Weil, KILIAN, Cologne, KOMAGE, Kell am See, KORSCH Pressen GmbH, Berlin, Mapag Maschinenbau AG, Bern (Switzerland) and Courtoy Nev., Halle (BE/LU). One example of a particular suitable tabletting machine is the model HPF 630 hydraulic double-pressure press manufactured by LAEIS, D.

The pressed elements can be made in certain shapes and certain sizes. Suitable shapes are virtually any easy-to-handle shapes, for example slabs, bars, cubes, squares and corresponding shapes with flat sides and, in particular, cylindrical forms of circular or oval cross-section. This last embodiment encompasses shapes from tablets to compact cylinders with a height-to-diameter ratio of more than 1.

The shape of another embodiment of the pressed elements is adapted in its dimensions to the dispensing compartment of commercial dishwashing machines, so that the pressed elements can be directly introduced with any aids into the dispensing compartment from which they are released during the dishwashing process. However, the pressed detergent elements may of course also readily be introduced by dispensing/metering aids.

After pressing, the pressed detergent elements have high stability. The fracture resistance of cylindrical elements can be determined via the diametral fracture stress. This in turn can be determined in accordance with the following equation:

$$\sigma = \frac{2P}{\pi D t}$$

where δ represents the diametrical fracture stress (DFS) in Pa, P is the force in the N which leads to the pressure applied to the pressed element that results in fracture thereof, D is the diameter of the pressed element in meters and t is its height.

The production of pressed elements is not confined to simply pressing a particulate compound to form a pressed element. Instead, the process can be extended to enable multilayer tablets to be produced in known manner by preparing two or more compounds which are pressed onto one another. In this case, the first compound to be introduced is lightly prepressed to obtain a smooth upper surface running parallel to the bottom of the pressed element, after the second compound has been introduced, is pressed to completion, i.e. to form a pressed element. In the case of three-layer or multilayer elements, each addition of compound is followed by further prepressing before the pressed element is completed after addition of the last compound.

In view of the increasing outlay on equipment, at most two-layer pressed element are preferred in practice. Advantages can be obtained from the allocation of certain ingredients to the individual layers. Thus, a two-layer pressed element can be produced by pressing two different particulate compounds onto one another, one of the compounds containing one or more bleaching agents and the other compound containing the particulate bleach activator corresponding to formula I, so that the pressed element formed contains the bleaching agent in the form of the peroxygen compound, more especially the inorganic peroxygen compound, in one layer and the particulate bleach activator corresponding to formula I in the second layer. However, the use of the bleach activator in particulate form in accordance with the invention also readily enables the bleaching agent and the bleaching activator to be incorporated in the same layer and other sensitive components, more especially enzymes, to be incorporated in a separate second layer of the pressed element.

Dishwashing detergents according to the invention may be used in domestic dishwashing machines and in institutional dishwashing machines. They are added by hand or by suitable dispensers. The concentrations in which they are used in the wash liquor generally amount to between about 1 and 8 g/l and preferably to between 2 and 5 g/l.

A machine dishwashing program is generally augmented and terminated by a few rinse cycles with clear water after the main wash cycle and a final rinse with a conventional rinse aid. After drying, completely and hygienically satisfactory dishes are obtained using detergents according to the invention.

EXAMPLES

Two-phase tablets M1 (each weighing 25 g) were produced by tabletting the ingredients listed in the following Table.

TABLE 1

Composition of the two-phase tablets (% by weight, based on the tablet as a whole)

| | First phase | Second phase |
|---|---|---|
| Sodium tripolyphosphate | 30 | 25 |
| Na perborate monohydrate | 10 | — |
| MMA granules[a)] | 3 | — |
| Polycarboxylate (Sokalan ® CP5) | 1 | — |
| Nonionic surfactant | 2 | — |
| Sodium carbonate | 15 | — |
| Layer silicate (SKS-6) | 6 | — |
| Complexing agent (Turpinal ® 2NZ) | — | 1 |
| Protease granules (Blap 200) | — | 2 |
| Amylase granules (Duramyl ® 60T) | — | 2 |
| Dye | — | 0.9 |
| Perfume | — | 0.1 |

[a)]produced by the process according to Example 7 or Example 8 of WO 98/23531, content of N-methyl morpholinium acetonitrile methosulfate 58%

Tablets which contained a mixture of 2% by weight of TAED (C1) or 2% by weight of N-methyl morpholinium acetonitrile methosulfate (C2) or 2% by weight of N-methyl morpholinium acetonitrile hydrogen sulfate (C3) with 1% by weight of silica, but which otherwise had the same composition, were produced for comparison.

The detergent tablets were tested using a Miele® G 590 dishwashing machine (water hardness 14–16° dH, operating temperature 45° C. and 55° C.). After the addition of a so-called frozen cube to increase the soil load, 8 cups soiled with standardized tea film were washed and removal of the film was then visually evaluated on a scale of 0 (=unchanged, very thick film) to 10 (=no film). Table 2 below shows the cleaning scores for the freshly produced detergents (starting value) and for detergents which had been stored for 2 weeks (room temperature or 30° C./80% relative air humidity.

TABLE 2

| | Cleaning scores | | |
|---|---|---|---|
| | Starting value | Storage at room temperature | Storage at 30° C./80% relative humidity |
| M1 at 45° C. | 9 | 9 | 9 |
| M1 at 55° C. | 10 | Not determined | Not determined |
| C1 at 45° C. | 5 | 5 | 5 |
| C1 at 55° C. | 6 | Not determined | Not determined |
| C2 at 45° C. | 6 | 4 | 4 |
| C3 at 45° C. | 8 | 6 | 6 |

It can be seen that the improvement in performance achievable by MMA over the standard TAED can be stably formulated into tablets by virtue of the particulate form. Results comparable with those for detergent M1 were obtained when the N-methyl morpholinium acetonitrile metho-sulfate on carrier material replaced by N-methyl morpholinium acetonitrile hydrogen sulfate on the same carrier material.

What is claimed is:

1. A method of cleaning dishes comprising the steps of forming a substantially aqueous cleaning solution with a solid detergent composition that comprises a peroxygen compound, a water-soluble salt of a divalent transition metal selected from the group consisting of cobalt, iron, copper, ruthenium, and mixtures thereof, and a water-soluble ammonium salt, activating the peroxygen compound in the aqueous cleaning solution with a compound of the formula (I):

$$R^1R^2R^3N\text{–}CH_2CN\ X \qquad (I)$$

that is carried in particulate form on an inorganic, silicon-containing carrier material, wherein $R^1$ is $C_1$ to $C_{18}$ alkyl, alkenyl or aryl, $R^2$ and $R^3$ independently are $C_1$ to $C_{18}$ alkyl, alkenyl or aryl or together form a heterocycle including the N atom and optionally other hetero atoms, and X is a charge-equalizing anion, and contacting a dish surface in need of cleaning with a cleaning-effective amount of the cleaning solution.

2. The method of claim 1, wherein the silicon-containing inorganic carrier material has an inner surface of 10 $m^2/g$ to 500 $m^2/g$.

3. The method of claim 2, wherein the silicon-containing inorganic carrier material has an inner surface of 100 $m^2/g$ to 450 $m^2/g$.

4. The method of claim 2, wherein the silicon-containing inorganic carrier material is selected from the group consisting of silicates, silicas, silica gels and clays, and mixtures thereof.

5. The method of claim 1, wherein the particles of the compound of formula (I) and carrier material comprise 10 to parts 50 parts by weight of the silicon-containing material and 50 to 90 parts by weight of the compound of formula (I).

6. The method of claim 1, wherein $R^2$, $R^3$, and the quaternary N atom form a morpholinium ring.

7. The method of claim 6, wherein $R^1$ is $C_1$ to $C_3$ alkyl.

8. The method of claim 7, wherein $R^1$ is methyl.

9. The method of claim 1, wherein X is selected from the group consisting of chloride, fluoride, iodide, bromide, nitrate, hydroxide, hexafluorophosphate, sulfate, hydrogen sulfate, metho- and ethosulfate, chlorate, perchlorate, formate, acetate, benzoate, citrate, and mixtures thereof.

10. The method of claim 1, wherein X is a halide or an anion of a carboxylic acid.

11. The method of claim 9, wherein X is sulfate, hydrogen sulfate, or methosulfate.

12. The method of claim 1, wherein the peroxygen compound activated is selected from the group consisting of organic peracids, hydrogen peroxide, perborate, percarbonate, and mixture thereof.

13. The method of claim 1, wherein the detergent further comprises a water-soluble salt of a divalent transition metal selected from the group consisting of cobalt, iron, copper, ruthenium, and mixtures thereof, a water-soluble ammonium salt, and optionally a peroxygen-based oxidizing agent.

14. A solid detergent composition comprising a bleaching agent, 0.5% to 7% by weight of a compound that forms a peroxocarboxylic acid under perhydrolysis conditions, and 1% to 10% by weight of a compound of the formula (I):

$$R^1R^2R^3N\text{–}CH_2CN\ X \qquad (I)$$

that is carried in particulate form on an inorganic, silicon-containing carrier material, wherein $R^1$ is $C_1$ to $C_{18}$ alkyl, alkenyl or aryl, $R^2$ and $R^3$ independently are $C_1$ to $C_{18}$ alkyl, alkenyl or aryl or together form a heterocycle including the N atom and optionally other hetero atoms, and X is a charge-equalizing anion.

15. The composition of claim 14, comprising 2% to 6% by weight of the compound of formula (I).

16. The composition of claim 14, comprising 15% to 70% by weight of a water-soluble builder and 5% to 25% by weight of the bleaching agent, said bleaching agent being oxygen-based.

17. The composition of claim 16, comprising 20% to 60% by weight of the water-soluble builder component and 80% to 17% by weight of the oxygen-based bleaching agent.

18. The composition of claim 14, wherein the bleaching agent is a peroxygen compound selected from the group consisting of organic peracids, hydrogen peroxide, perborate, percarbonate, and mixture thereof.

19. The composition of claim 14, comprising 0.5% to 7% by weight of a compounds that forms a peroxocarboxylic acid under perhydrolysis conditions.

20. The composition of claim 14, further comprising a water-soluble salt of a divalent transition metal selected from the group consisting of cobalt, iron, copper, ruthenium, and mixtures thereof, a water-soluble ammonium salt.

21. The composition of claim 14, further comprising 0.0025% to 0.5% weight of a bleach-catalyzing transition metal salt or complex.

22. The composition of claim 21, wherein the bleach-catalyzing transition metal salt or complex is a cobalt-, iron-, copper-, or ruthenium-ammine complex.

23. The composition of claim 22, wherein the bleach-catalyzing transition metal salt or complex is $[Co(NH_3)_5Cl]Cl_2$, $[Co(NH_3)_5NO_2]Cl_2$, or a mixture thereof.

24. The solid detergent composition of claim 14 in the form of a pressed shape.

25. The solid detergent composition of claim 24, in the form of a pressed shape comprises two or more layers.

26. The solid detergent composition of claim 25, wherein the bleaching agent is in the form of a peroxygen compound and is contained in one or more layers, and the compound of formula I contained in one or more layers that do not contain the peroxygen compound.

27. The solid detergent composition of claim 24, wherein the bleaching agent comprises a peroxygen compound and the bleaching agent and the compound of formula (I) are contained in or more layers, and an enzyme is contained in one or more layers that do not contain the bleaching agent comprising a peroxygen compound or the compound of formula (I).

28. A method of cleaning dishes comprising the steps of forming a substantially aqueous cleaning solution with a solid detergent composition that comprises 0.5% to 7% by weight of a peroxygen compound selected from the group consisting of organic peracids, hydrogen peroxide, perborate, percarbonate, and mixtures thereof, activating the peroxygen compound in the aqueous cleaning solution with a compound of the formula (I):

$$R^1R^2R^3N\text{-}CH_2CN\ X \qquad (I)$$

that is carried in particulate form on an inorganic, silicon-containing carrier material selected from the group consisting of silicates, silicas, silica gels and clays, and mixtures thereof having an inner surface of 10 $m^2/g$ to 500 $m^2/g$, wherein $R^1$ is $C_1$ to $C_3$ alkyl and $R^2$, $R^3$, and the quaternary N atom form a morpholinium ring, and X is a charge-equalizing anion, and containing a dish surface in need of cleaning with a cleaning-effective amount of the cleaning solution.

* * * * *

UNITED STATES PATENT AND TRADEMARK OFFICE

CERTIFICATE OF CORRECTION

PATENT NO. : 6,407,045 B1 
DATED : June 18, 2002
INVENTOR(S) : Christian Nitsch et al.

It is certified that error appears in the above-identified patent and that said Letters Patent is hereby corrected as shown below:

Title page,
After Item [60], Reference "March 29, 1999" insert the following:
-- [30] Foreign Application Priority Data
Dec. 15, 1998 (DE)……..198 57 596.3 --.
Item [57], ABSTRACT,
Lines 5 and 6, delete "$R^1R^2R^3N^-CH_2CN\ X^+$", and insert therefor
-- $R^1R^2R^3N^+CH_2CN\ X^-$ --.

Column 15,
Line 34, delete "$R^1R^2R^3N\text{-}CH_2CN\ X$", and insert therefor -- $R^1R^2R^3N{+}CH_2CN\ X$ --.
Line 55, delete the first occurrence of "parts" and after "silicon-containing", insert -- carrier --.

Column 16,
Line 6, delete "mixture", and insert therefor -- mixtures --.
Line 16, delete "$R^1R^2R^3N\text{-}CH_2CN\ X$", and insert therefor -- $R^1R^2R^3N{+}CH_2CN\ X$ --.
Line 25, after "claim 14," insert -- further --.
Line 30, delete "80%", and insert -- 8% --.
Line 35, delete "mixture", and insert therfor -- mixtures --.
Lines 54 and 55, delete "in the form of a", and insert therefor -- wherein the --.
Line 64, after "contained in", insert -- one --.

Column 17,
Line 10, delete "$R^1R^2R^3N\text{-}CH_2CN\ X$", and insert therefor -- $R^1R^2R^3N{+}CH_2CN\ X$ --.

Column 18,
Line 7, delete "containing", and insert therefor -- contacting --.

Signed and Sealed this

Ninth Day of September, 2003

JAMES E. ROGAN
*Director of the United States Patent and Trademark Office*